United States Patent [19]

Patterson

[11] Patent Number: 4,713,842

[45] Date of Patent: Dec. 22, 1987

[54] PROTECTIVE MULTIPLE FEEDING MEANS GARMENT

[76] Inventor: Jerusha A. Patterson, 5902 31st Ave., #512, Hyattsville, Md. 20782

[21] Appl. No.: 913,974

[22] Filed: Oct. 1, 1986

[51] Int. Cl.[4] ..... A41D 1/20

[52] U.S. Cl. ..... 2/104; 224/202; 224/148

[58] Field of Search ..... 2/DIG. 6, 104; 224/148, 224/202

[56] References Cited

U.S. PATENT DOCUMENTS

| | | | |
|---|---|---|---|
| 298,985 | 5/1884 | Kimball | 224/148 |
| 1,290,142 | 1/1919 | Elowsky | 2/104 |
| 2,417,888 | 3/1947 | Schuster | 2/104 |
| 3,197,099 | 7/1965 | Doba | 224/148 |
| 3,977,638 | 8/1976 | Woodard | 224/202 |
| 4,004,294 | 1/1977 | Pinch | 2/104 |
| 4,031,566 | 6/1977 | Johnson | 2/104 |
| 4,564,957 | 1/1986 | Scharf | 2/DIG. 6 |
| 4,601,068 | 7/1986 | Frechette | 2/104 |

*Primary Examiner*—Louis K. Rimrodt

*Attorney, Agent, or Firm*—Jerome J. Norris

[57] ABSTRACT

A protective single-piece garment for a wearer which allows a baby to be breast fed or bottle fed comprising elastic means for holding a bottle in a feeding position without the aid of a hand, and a snap-away panel thereunder for breast feeding.

4 Claims, 4 Drawing Figures

PROTECTIVE MULTIPLE FEEDING MEANS GARMENT

BACKGROUND OF THE INVENTION

The invention pertains to wearing apparel or garments for the care of babies, wherein the mother's clothing is kept free from soiling during breast or bottle feeding.

When handling or feeding babies, it is essential to exert utmost care in order to protect them from contact with the wearer's clothing or anything from which germs might be contracted. For example, in the process of bottle feeding, the nipple must be kept sterile and must not be allowed to come in contact with anything except the baby's mouth.

It is also desirable to protect the clothing of the mother or person caring for the baby from soiling caused by wetting, burping, etc., and to provide wearing apparel or garments which can be used with ease to provide sanitation for the infant.

Finally, in feeding or handling the baby, it is further desirable for the mother or handler to have a garment which allows the hand normally used for holding the bottle to be free for other purposes, without interrupting the feeding process.

SUMMARY OF THE INVENTION

In accordance with the instant invention, a single-piece baby feeding garment is provided that allows a mother to either breast feed or bottle feed an infant. The garment is arranged to cover at least the upper body area or chest of the mother. A series of elastic loops for receiving and securing a baby bottle therein are attached to the right and left upper areas of the garment to allow bottle feeding without the need to hold the bottle in the hand.

Directly beneath the series of receiving and securing elastic loops, is a snap-away panel which allows the mother to breast feed the baby, if so desired.

A utility pocket for holding various items and articles used for the infant's needs is disposed under the snap-away panel on the front side of the multiple feeding means garment.

An exemplary embodiment of the invention is in a short sleeve form, and made of a soft absorbent material, i.e. terry cloth, which can be worn by one caring for a baby at feeding time, and which will keep the baby from contact with the clothing of the handler.

The feeding garment may be slipped on directly over the wearer's head when securing straps on the back of the garment are tied, or it can be put on by inserting the arms through sleeve openings, and tying the securing straps.

It is an object of the present invention to provide a protective garment which allows a mother to either breast feed or bottle feed an infant.

A further object of the invention is to provide a protective garment which receives and secures a bottle in the nursing position without support of the hand normally used for this purpose.

A yet further object of the invention is to provide an absorbent protective garment which keeps the baby-handler's clothing free from soiling caused by burping, wetting, etc.

Other objects of the invention will become more apparent from the detailed descriptions of the invention hereinafter set forth.

DETAILED DESCRIPTION OF THE PREFERRED EMBODIMENTS

Figure 1:
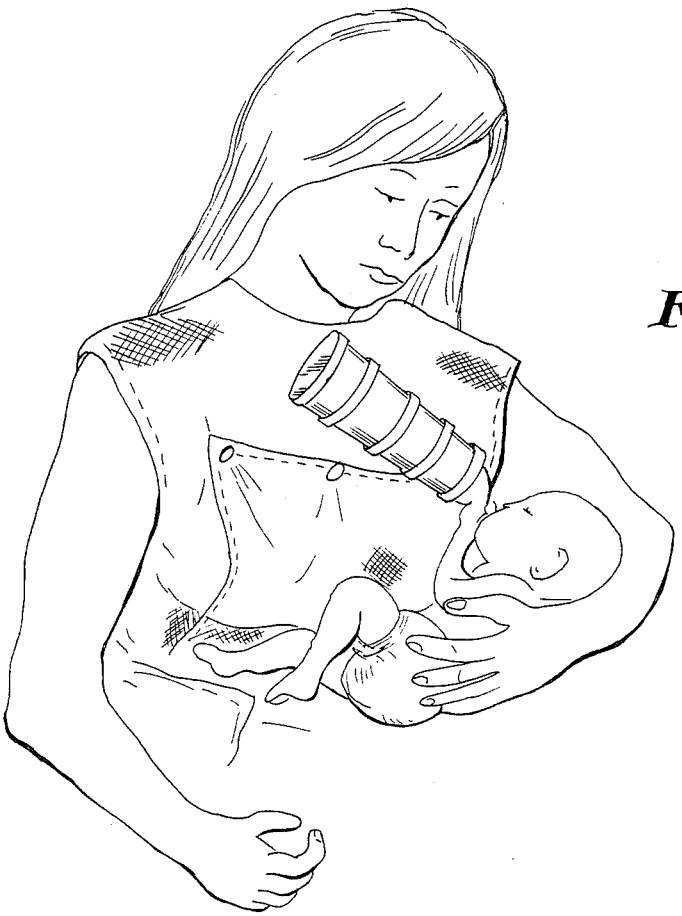
FIG. 1 is a perspective partial view of the multiple feeding means protective garment on a wearer during bottle feeding.

Reference is made to FIG. 1, wherein a multiple feeding means protective garment 1 is worn in the bottle feeding arrangement by a wearer. In this arrangement, receiving and securing elastic loops 2, which are positioned to accommodate a left-handed wearer, hold bottle 3, in the feeding position in an infant's mouth. Breast feeding panel 4, is in the closed position, and the preferred means of securing said panel in the closed position is via snap fasteners 5, of the ball and socket type; however, VELCRO ® or other types of fasteners well known in the art would suffice equally as well.

Figure 2:
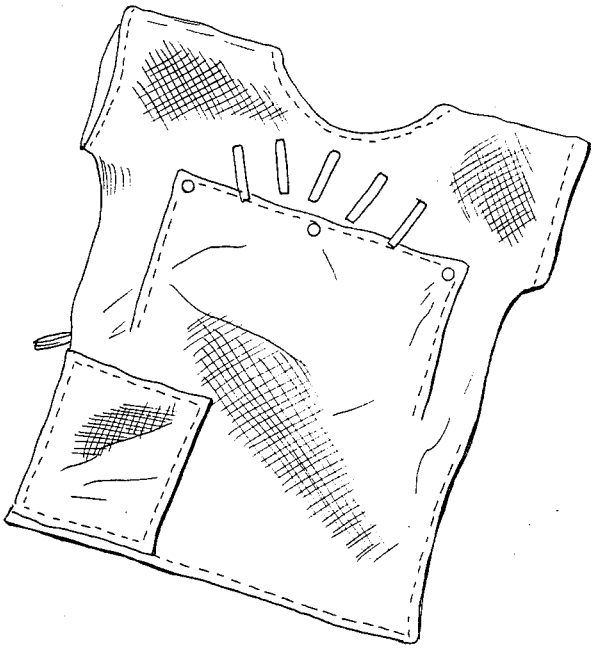
FIG. 2 is a perspective view of the front of the multiple feeding means protective garment in the bottle feeding arrangement, showing right-handed and left-handed bottle receiving and securing elastic loopps, and the snap-away breast feeding panel in the closed position.

The view of FIG. 2 shows the front of the multiple feeding means protective garment with a full array or both the left-handed and right-handed bottle receiving and securing elastic loops. It is essential that the bottle receiving and securing means be elastic and affixed to a portion of the garment above the snap-away breast feeding panel, in a plurality of loops arranged in inverted arcuate or inverted arc-like form. This elastic arrangement allows the garment to be used to accommodate either left-handed or right-handed wearers during bottle feeding, and also allows bottles of different sizes and weights to be held in the correct position for different size wearers and different size infants.

While it is preferred that the elastic loops be affixed to the garment by sewing using ordinary sewing threads, the invention can also employ snap or VELCRO ® fasteners for this purpose.

Figure 3:
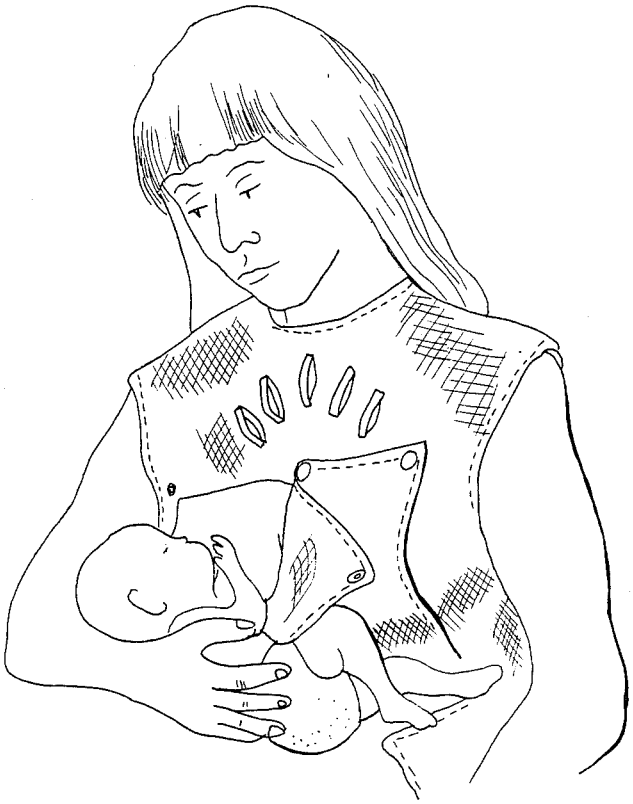
FIG. 3 is a perspective partial view of the multiple feeding means protective garment on a mother during breast feeding, wherein a portion of the breast feeding panel is snapped-off.

Snap fasteners 5, are disposed at the upper areas of the snap-away breast feeding panel at the corners and in the mid-position. In this snap fastener configuration, breast feeding may be accomplished by a mother holding a baby with the right arm, by first unsnapping the upper right snap fastener and leaving the mid-point and upper left snappers fastened, as shown in FIG. 3. Breast feeding for a mother holding a baby with the left arm is accomplished by unsnapping the upper left fastener, and alternating breast feeding may be accomplished by unsnapping all of the fasteners.

It is preferred that the multiple feeding means garment be made of a soft absorbent material such as terry cloth; however, any absorbent material per se or a combination of absorbent and repellent materials will suffice, as long as the breast feeding snap-away panel and bottle receiving and securing elastic loops are positioned as above described.

At least one utility pocket 6, as shown in FIG. 2, can be attached by sewing for purposes of holding various items and articles used for the infant's care.

Figure 4:
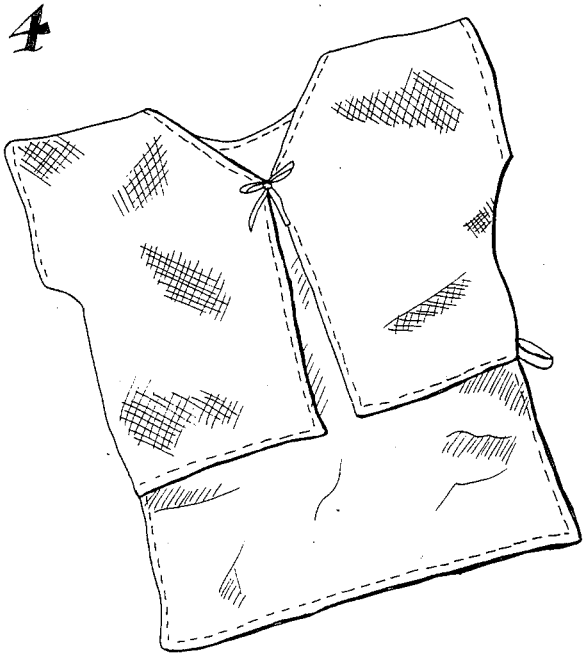
FIG. 4 is a perspective rear view of the multiple feeding means protective garment showing the securing straps in the tied position.

FIG. 4, shows a rear view of the multiple feeding means protective garment, wherein back panels 7, are held together by tied securing straps. In this configuration, the garment can be slipped over the wearer's head. In the untied position, the garment can be placed on the user in a manner opposite to putting on a vest. Loop 8, which is sewn on between the lower outside edge of panel 7 and the front of the garment, may be elastic or non-elastic, and is used to hang the garment on a hook or support when it is not being used to care for the baby.

It is to be understood that many changes may be made to the above described garment without departing from the spirit and scope of the invention, which has been set forth in an illustrative and not a limiting sense.

What is claimed is:

1. A protective single-piece garment for a wearer, which allows a baby to be breast fed or bottle fed comprising: garment means that cover the chest area of the wearer; a series of receiving and securing elastic bottle holding loops arranged in inverted arcuate form and affixed to the front upper part of said garment above the breast area of the wearer to hold a bottle in the feeding position without support of the wearer's hand during feeding; and snap-away panel means secured in a fastened position on the breast area under said series of receiving and securing elastic means.

2. The protective single-piece garment of claim 1, wherein said snap-away panel means are secured by ball and socket snap fasteners.

3. The protective single-piece garment of claim 2, wherein the material is terry cloth, and the receiving and securing elastic loop means is affixed by sewing thread; said garment having further affixed thereto in a position beneath said snap-away panel, at least one utility pocket for holding infant care items.

4. The protective single-piece garment of claim 3, further having two panels as a area area with securing straps affixed thereto for tying said panels together, and a loop sewn between a lower outside edge of one rear panel and front portion in order to hang said garment on a support when it is not in feeding use.

* * * * *